US005732490A

United States Patent [19]

Hydary

[11] Patent Number: 5,732,490

[45] Date of Patent: Mar. 31, 1998

[54] PERPETUAL CALENDAR

[76] Inventor: Mainul H. Hydary, Apt. 405, 1570 Lawrence Avenue West, North York, Ontario, Canada, M6L 1C2

[21] Appl. No.: 419,211

[22] Filed: Apr. 10, 1995

Related U.S. Application Data

[63] Continuation-in-part of Ser. No. 329,939, Oct. 27, 1994, Pat. No. 5,581,920.

[51] Int. Cl.[6] ..... G09D 3/08

[52] U.S. Cl. ..... 40/115; 40/113; 116/318; 283/2

[58] Field of Search ..... 40/113, 115, 495; 116/309, 316, 223; 283/2

[56] References Cited

U.S. PATENT DOCUMENTS

| | | | |
|---|---|---|---|
| 217,433 | 7/1879 | Trum . | |
| 239,867 | 4/1881 | Smith . | |
| 256,396 | 4/1882 | Smith . | |
| 375,736 | 1/1888 | David | 40/115 |
| 506,003 | 10/1893 | Dreyfus | 40/113 |
| 728,904 | 5/1903 | Graessle . | |
| 730,685 | 6/1903 | Norman | 40/115 |
| 1,280,837 | 10/1918 | Randall | 40/113 |
| 2,006,485 | 7/1935 | Segal | 40/115 |
| 2,502,852 | 4/1950 | Justice, Jr. | 40/115 |
| 2,631,391 | 3/1953 | Hanna | 40/113 |
| 2,952,932 | 9/1960 | Beer | 40/113 |
| 3,468,048 | 9/1969 | Smith . | |
| 5,197,043 | 3/1993 | Strader | 368/27 |

FOREIGN PATENT DOCUMENTS

| | | |
|---|---|---|
| 651428 | 2/1929 | France . |
| 3103650 | 2/1982 | Germany . |
| 1250871 | 10/1971 | United Kingdom . |

*Primary Examiner*—Brian K. Green
*Attorney, Agent, or Firm*—Peter R. Hammond

[57] ABSTRACT

A perpetual calendar has a top sheet member having several viewing apertures formed therein. The top sheet displays on a top surface thereof in seven vertical columns the dates of the month from one to twenty-eight. One of the apertures is positioned to display up to three additional dates of the month after the numeral 28. An intermediate substrate layer is disposed beneath the top sheet and is rotatably mounted thereto. This substrate displays on a top surface thereof data for indicating days of the week, which is displayable through one of the apertures. A bottom substrate or sheet is disposed beneath the intermediate substrate and is rotatably mounted with respect to the other two substrates or sheets. This substrate layer displays on a top surface thereof the 12 months of the year and also month ending date or dates for months having more than 28 days. This substrate is rotatable to display the current month through one aperture and correct month ending date or dates for that month through another aperture. Preferably the device is also capable of displaying through apertures of the top sheet data relating to zodiac signs for the indicated month.

15 Claims, 7 Drawing Sheets

32
70
30
33
34
35
40
42
44
45
47
48
49
72
D L M M J V S D L M M J V S
SU MO TU WE TH FR SA SU MO TU WE TH FR SA
JAN FEB FEB MAR APR MAY JUN JUL AUG SEP OCT NOV DEC
1st New Year
LEAP YEAR
4th INDEPEN -DENCE
25th CHRIST -MAS
CAPRICORN Dec 22 - Jan 20
AQUARIUS Jan 20 - Feb 19
PISCES Feb 20 - Mar 20
ARIES Mar 21 - Apr 19
TAURUS Apr 20 - May 20
GEMINI May 21 - Jun 21
CANCER Jun 22 - Jul 22
LEO Jul 23 - Aug 22
VIRGO Aug 23 - Sep 22
LIBRA Sep 23 - Oct 23
SCORPIO Oct 24 - Nov 22
SAGITTARIUS Nov 23 - Dec 21

PERPETUAL CALENDAR

CROSS-REFERENCE

This applications is a continuation-in-part application of U.S. patent application Ser. No. 08/329,939 filed Oct. 27, 1994, now U.S. Pat. No. 5,581,920.

FIELD OF THE INVENTION

The invention relates to the field of calendars and, more particularly, to perpetual calendar systems.

BACKGROUND OF THE INVENTION

Perpetual calendars are calendars which can be used year after year by simply setting the calendar in the appropriate position for the current year. Thus, perpetual calendars are convenient devices to own and use. A number of mechanical perpetual calendar systems are known in the art, ranging from complex mechanical machinery to simpler card-based systems.

U.S. Pat. No. 217,433 issued Jul. 8, 1979 to E. J. Trum discloses a perpetual calendar comprising a fixed base card onto which is marked days of the month in rows, ie. in calendar form. Two strips of removable cards lie above and below the base card and have printed on them the month, year and days of the week. One strip indicates the month last past and the other strip the current month. The days of the week marked on the strips are aligned with the rows of the days of the month marked on the base card. As the months expire, the topmost card of each strip is removed to show the next cycle of the current and past month and the days of the week appropriately aligned with the days of the month on the base card. Eventually, of course, the strips need to be replenished.

U.S. Pat. No. 239,867 issued Apr. 5, 1881 to J. G. Smith describes a calendar ink stand having a nose around which is arranged a band having on its outer surface the days of the week arranged in order and can be turned, as required. The top of the ink stand is divided into five concentric rings and seven sectors in order to display the days of the month from 1 to 31. On the bottom of the ink stand there is a rim and located concentrically therein is a band having the names of the month displayed on the outer surface thereof. The proper month can be exposed at one point by means of a window in the rim. It is necessary for the user to always know how many days the current month has in order to be alerted thereon to change the day of the week setting to the first of the next month.

U.S. Pat. No. 256,396 issued Apr. 11, 1882 to J. G. Smith discloses a calendar ink flask wherein the days of the month are fixedly displayed on the side of the flask and the current month is displayed through a window in the base of the flask. On the neck of the flask lies an adjustable neck band having the days of the week arranged in order thereon. The neck band can be turned so as to bring the proper day of the week to correspond to the first of the month. It is necessary for the user to always know how many days the current month has in order to change the day of the week setting to the first of the next month at the appropriate time.

U.K. patent No. 1,250,871 published Oct. 20, 1971 to J. J. Robinson discloses a complex mechanical perpetual calendar system. The mechanical calendar comprises a casing formed with four viewing apertures and four annular gear units with data thereon rotatably mounted correspondingly to the casing so as to exhibit the data through the apertures. The first gear unit shows the year, the second the months of the year, the third the days of the week, and the fourth the date, i.e. numerical day of the month. Actuating means allow the first and third gear units to be selectively rotated independently of the second and fourth gear units to simultaneously alter the year numeral and day displayed. The second and fourth gear units can be rotated independently of the first and third gear units to simultaneously alter the month and date displayed. In order that the correct number of days be shown for the month, the calendar employs on the date gear unit four date covers, each comprising an arcuate strip provided with a rearward projection that extends through a horizontal through slit formed in each date quadrant. This calendar, by virtue of its relatively complex mechanics, is a relatively expensive item to produce.

SUMMARY OF THE INVENTION

According to one aspect of the invention, there is provided a perpetual calendar device comprising a first, flat, sheet member having at least first, second and third viewing apertures formed therein, the first sheet member displaying on a front surface thereof in seven columns dates of the month from the numeral "1" to the numeral "28", the second viewing aperture being positioned above the seven vertical columns and having a width substantially corresponding thereto, the third viewing aperture being positioned to display up to three additional dates of the month after the numeral "28"; a second, flat, sheet member disposed beneath said first sheet member and rotatably mounted thereto, the second sheet member displaying on a front side thereof data for indicating days of the week, the second sheet member being rotatable to display days of the week data through the second viewing aperture for a given month; and a third, flat, sheet member disposed beneath said first sheet member and rotatably mounted thereto, the third sheet member displaying on a front side thereof the twelve months of the year and further displaying variable month ending dates for months having more than 28 days, the third sheet member being rotatable to display a given month through the first viewing aperture and correct month ending dates for the given month through the third viewing aperture.

According to another aspect of the invention, there is provided a perpetual calendar device comprising a flat sheet member having viewing apertures formed therein, the sheet member displaying on a front side thereof dates of the month arranged in columns, the apertures being provided to permit data or information displayed below said sheet member to be seen; and a flat data displaying member rotatably mounted to the sheet member displaying on a surface adjacent the sheet member data relating to zodiac signs, which data is arranged for viewing through at least one of the apertures, only selected portions of the data being visible through at least one of the apertures at any one time, wherein the data displaying member can be rotated to display through at least one of the apertures data relating to a zodiac sign applicable to a particular month of the calendar year.

BRIEF DESCRIPTION OF THE DRAWINGS

The present invention will be understood and appreciated more fully from the following non-limiting detailed description, taken in conjunction with the drawings in which.

DETAILED DESCRIPTION OF THE DRAWINGS

Figure 1:
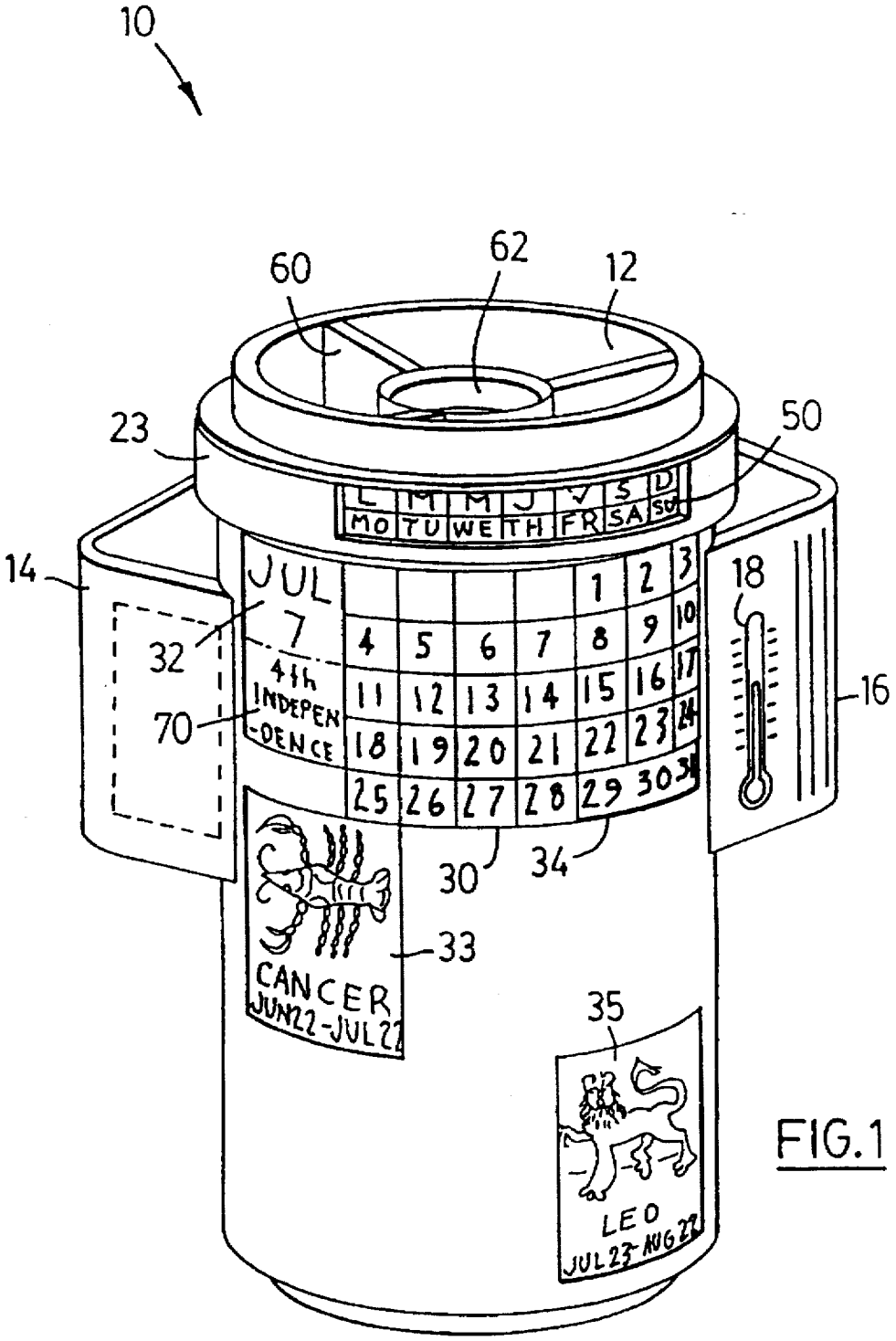
FIG. 1 is a perspective view illustration of one preferred embodiment of the perpetual calendar of the invention, which includes various supplementary holders

FIG. 1 shows in perspective view a preferred embodiment of a perpetual calendar 10 which has a generally cylindrical shape. The calendar 10 preferably comprises supplementary holders including an open top chamber 12 for use as a pen and pencil holder, an outwardly projecting side extension or holder 14 for mounting and displaying a small photograph therein and a further side extension or holder 16 wherein a thermometer can be mounted. Of course, other uses may be made of these supplementary holders and the position of the side extensions 14, 16 may be varied so long as they do not interfere with the operation of the calendar itself.

Figure 2:
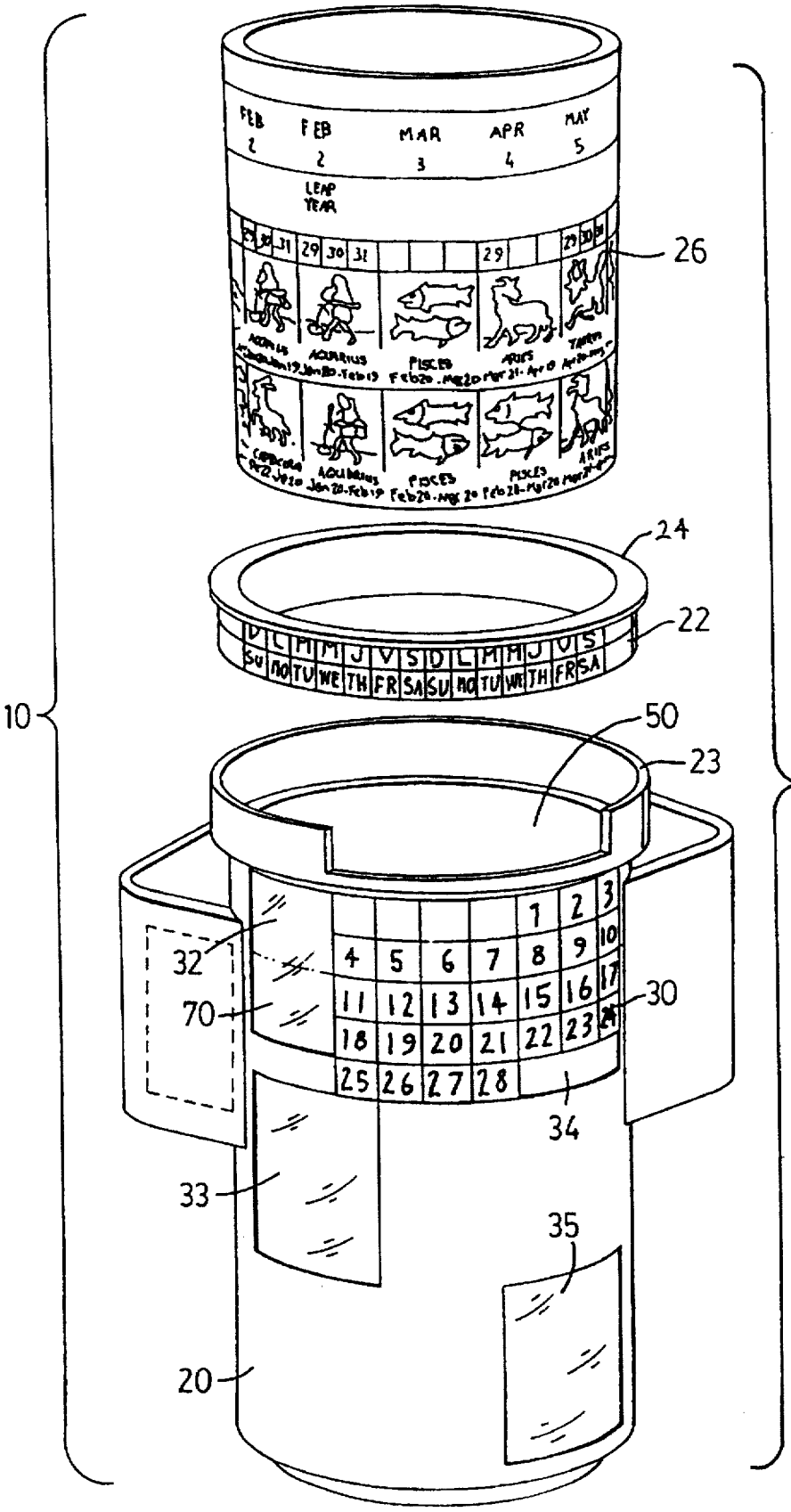
FIG. 2 is an exploded view diagram showing three components of the calendar depicted in FIG. 1.

Referring to FIG. 2, the calendar 10 includes three major separable components: a main cylindrical housing or outer casing 20 which may be cup shaped, an annular ring member 22 with an outwardly extending flange 24 at the top thereof, and an inner cylinder 26 open at the top thereof (preferably closed at the bottom thereof). The ring member 22 has an outer diameter sized to permit it to fit into the top of the housing 20. The flange 24 of the ring member 22 acts to seat it on an upper rim portion 23 of the housing. Similarly, the cylinder 26 has an outer diameter sized to permit it to slide through the ring member 22 and into the housing 20, with the flange 28 acting to seat the cylinder 26 on the ring member 22.

Mounted on the housing 20 is a calendar date chart 30 bearing the numbers 1 to 28 in five horizontal rows and seven vertical rows or columns. The numbers 1 to 3 can be in the first horizontal row while the final numbers 25 to 28 can be in the last horizontal row.

The housing 20 is equipped with preferably five windows or viewing apertures indicated by reference numerals 32 to 35 and 70. Each of windows 32 to 35 and 70 can either be an open window or covered with a clear plastic or glass so that it is transparent.

Figures 3, 4, 5:
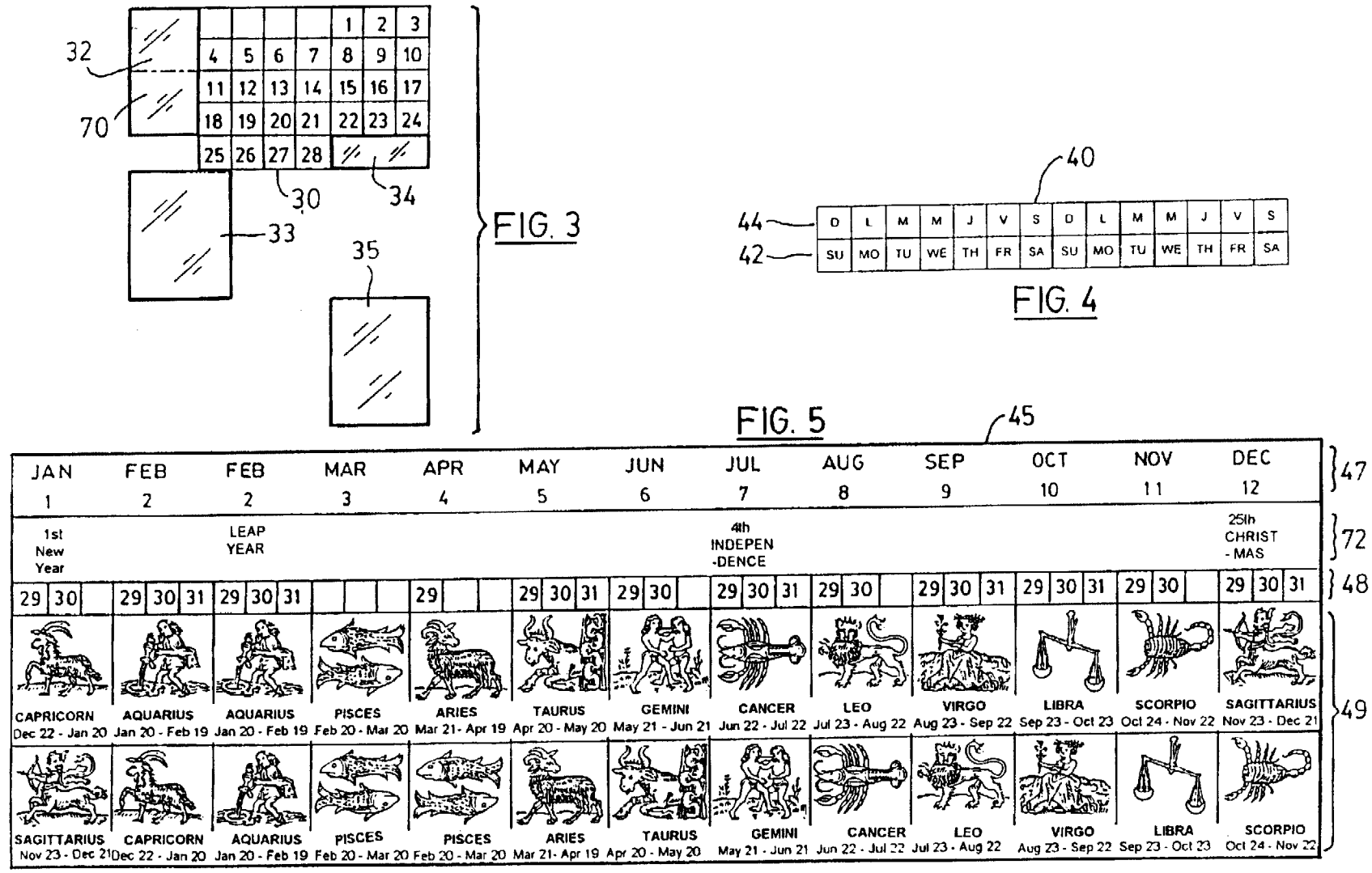
FIG. 3 is a schematic diagram of a layout for the days of the month as well as windows for showing the month of the year and zodiac signs for the month.
FIG. 4 is a schematic diagram of a printed layout for an annular ring, the layout indicating the days of the week in short form for both English and French.
FIG. 5 is a schematic diagram of a main printed layout for an inner cylinder, the layout showing month and zodiac sign information.

Referring additionally to FIG. 3, the layout for the date chart 30 and the windows 32 to 35 and 70 is shown more clearly. The window 32 is employed to display the current month, such as one of "May, June, July, etc.", and the number of the month, which in the case of the month of July is the number 7 since it is the seventh month. The windows or apertures 33 and 35 are employed to display the zodiac names and signs corresponding to the current calendar month, there being two zodiac signs applicable for each calendar month. The window 34 is situated proximate to the date chart 30 and employed to display "variable" ending dates of the calendar month since the calendar months do not all have an equal number of days. As shown in FIG. 1 for example for the month of July, which has 31 days, the numbers 29, 30 and 31 are displayed in the window 34 after the numeral "28".

The underlying information or data which is displayed through the windows 32–35 is shown in FIG. 5 (not drawn to scale). The information can be printed on a paper or plastic strip 45 which is wrapped around and affixed onto the outside of the inner cylinder 26. This information could also be printed or painted directly on the surface of the inner cylinder. The top portion of the strip 45, indicated by reference numeral 47, comprises a row of the names and numbers of the twelve months, of which one month's data is displayed through the window 32. The mid-portion of the strip 45, indicated by reference numeral 48, comprises a row of the variable ending date information for the calendar month which is displayed through the window 34. It will be appreciated that the row of the month ending date or dates is offset from the row of names and numbers of the months by a distance equal to the spacing between windows 32 and 34. Finally, the bottom portion of the strip 45, indicated by reference numeral 49, comprises two rows of the zodiac sign data or information which is displayed in windows 33 and 35. The rows of zodiac sign information can be offset therebetween by a distance equal to the spacing between windows 33 and 35 less the width of the space occupied in each row by the data for one zodiac sign.

It should be noted from FIG. 5 that the month of February and its number "2" are shown twice in top portion 47. In addition, the two zodiac signs that include the month of February, namely Aquarius and Pisces, are shown twice in one of the two horizontal rows. This is to accommodate leap years when February has 29 days instead of 28. The second February setting, if used, will result in the date number "29" appearing in the window 34. Also, in the preferred version, the words "leap year" will show up in the window 70.

Referring to FIG. 4, a paper or plastic strip 40 having printed thereon horizontal rows of data in the form of letters identifying days of the week is wrapped around and affixed to the ring member 22. Alternatively, the weekday letters can be printed directly on the ring member. The correct sequence of letters for the ring 22 is shown in FIG. 4 with the letter "MO" representing Monday, the letter "TU" representing Tuesday, etc. If a unilingual calendar is desired, one row of letters is sufficient. However, a second row of characters could be used to provide a second language weekday readout. For example, the first horizontal row indicated at 44 can be letters for the French language days of the week while the lower row 42 can be letters for the English language days of the week. In any event, the letters of the one or two rows can be viewed through a horizontally extending gap 50 which can be seen in FIG. 1. The gap 50 is formed by a break in the upper rim section 23 which projects upwardly and outwardly from the main housing 20. The gap permits the display of seven letters or letter combinations only (per horizontal row) representing the seven days of the week. These letters are displayed directly above the seven vertical rows of date numbers on the housing 20. The ring member 22 extends across the gap 50 to display the seven days of the week.

In use, the perpetual calendar of the invention must be set each month. To do so, one initially notes from another calendar the day of the week on which the first day of the current month falls. One then turns the annular ring member 22 until the correct day of the week is positioned directly above the number 1 (on the housing 20) representing the first day of the month. At the same time the inner cylinder 26 is turned so that the correct month appears in the window 32. Doing so will also cause the correct sequence of "variable dates" to appear in the window 34, thereby completing the date display for the current month. Additionally, the appropriate zodiac signs will appear in the windows 33 and 35. Having set the calendar 10 initially in this manner, at the end of the current month the day of the week upon which it falls is noted, and the calendar 10 is reset as described above to have the next day of the week aligned with the number 1 representing the first day of the next month. Thus, the calendar 10 may be perpetually reset without referring to an external calendar source unless one chooses to do so (after the initial setting by the user).

It will be appreciated by those skilled in the art that a perpetual calendar embodying one or more aspects of the invention need not have all of the features of the illustrated calendar shown in the drawings. For example, it is possible to construct a perpetual calendar which although capable of displaying through the aperture 34 the month ending date or dates, is not capable of displaying the additional 29th day for February in a leap year. The inability to display the 29th day for February would not seriously affect the usefulness of the calendar since this 29th day only appears once in four years. In such a version of the calendar it would only be necessary to display February once on the inner cylinder.

It is also possible, of course, to construct a useful perpetual calendar in accordance with one aspect of the invention wherein the zodiac sign information for the selected month is not displayed through windows or apertures. Thus, in one version of the invention, the apertures 33 and 35 could be omitted along with the zodiac sign information on the inner cylinder 26. On the other hand, it is also possible to construct a perpetual calendar which has the capability of displaying the zodiac sign information for the current month but which does not have a separate aperture, for example, for displaying the current month. The current month could, for example, be displayed through the same aperture as that used for the zodiac sign information. It is also possible to construct a perpetual calendar in accordance with the invention wherein all of the appropriate zodiac sign information for a particular month is shown through a single aperture or window. The advantage of showing the zodiac sign information through two separate windows is that it clearly separates the information relating to the two signs for the month and also the position of the two windows corresponds roughly to the location of the dates in the month for which the zodiac sign is appropriate. For example, the Capricorn sign is displayed in the upper lefthand aperture 33 during the month of January and this position corresponds roughly to the position of the initial 19 days in January for which the sign applies. Similarly, the Aquarius sign appears in the lower righthand aperture 35 during the month of January and this sign applies to the last 12 days of January.

In a particularly preferred embodiment of the inner cylinder, this cylinder is hollow and has several dividers or partitions 60 extending vertically and radially. These divide the inner cylinder into several compartments for holding a variety of objects. If desired, the divider 60 can extend inwardly to a small central cup 62 that might, for example, be used to hold an eraser or perhaps some paperclips.

In addition to having optional holders for photographs or a thermometer, the unused exterior surface of the outer casing can be used to display useful information such as conversion tables for distances, weights, temperatures, etc. This information could, for example, be displayed on the back of the outer casing opposite the calendar.

It will also be appreciated that it is possible to display the 12 months of the year and the month ending date or dates in a different manner than that shown in the drawings and described above. For example, it is possible for the 12 months of the year to be displayed on one rotating cylinder while the month ending date or dates is displayed on a separate rotating cylinder with both cylinders being mounted in the outer casing. Although such an arrangement is quite feasible, it might be less advantageous than the preferred embodiment illustrated in FIGS. 1 and 2, which embodiment always ensures that for every month displayed in aperture 32, the correct month ending date or dates will be shown in aperture 34. It is also conceivable that instead of having the month displayed by means of a rotating cylinder, the 12 months of the year could be shown on a rotating disk mounted in the outer casing in such a manner that again only one month of the year is displayed in any one time through a window or aperture.

Preferably the housing 20 has a closed bottom end so that objects or pens placed in the interior of the device will not fall through.

The additional aperture or window 70 is optional and can be provided in the outer casing for displaying a special day that month such as a national holiday or a religious date such as Christmas. As indicated, it also can be used to show "leap year" in the leap year month of February. This aperture can be located below the first aperture 32 for the month. As indicated by the dashed line in FIG. 3, the window area 70 need not be a separate window but it can be combined with the window 32 to form a single window displaying both the month and a special day in the month. These special days can be displayed on the inner cylinder in the horizontal strip region indicated at 72 in FIG. 5. A personal date such as a birthday could be written in the region 72 or placed in the region by means of a sticker with the date printed thereon (not shown).

Also, the interior casing need not be completely cylindrical on its exterior. The housing 20 can be flattened on one side if desired while still retaining its cylindrical interior surface. This flattening may provide better viewing of a photo held in one side section of the housing or the thermometer.

It will be appreciated that the present invention is a relatively inexpensive item to produce. Additionally, leap years are accurately accounted for and no further accessories need to be purchased in order for the calendar to work perpetually, unlike some calendar systems of the prior art.

Figure 6:
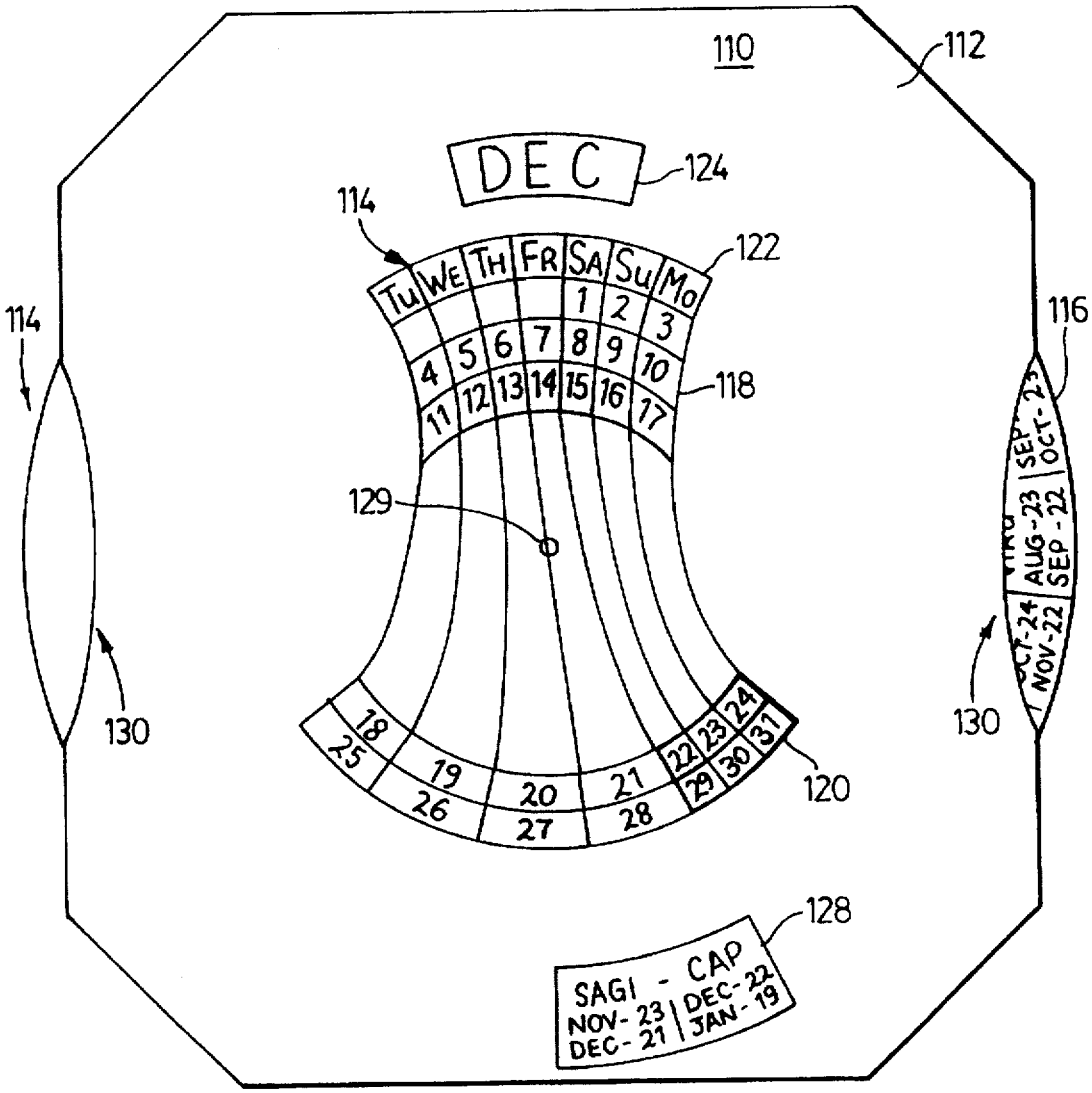
FIG. 6 is a top view of a flat, non-cylindrical perpetual calendar device in accordance with a preferred variation of the present invention.

FIG. 6 shows a flat perpetual calendar device 110 in accordance with a preferred variation of the invention. The device 110 comprises three substrate layers: a first, topmost substrate 112, illustrated by itself in FIG. 7; a second, intermediate substrate 114, illustrated by itself in FIG. 8; and a third, bottom-most substrate 116, illustrated by itself in FIG. 9. The substrates or flat sheets 112, 114, 116 can be constructed from practically any material, such as plastics, paper, metal, etc., although plastic is the preferred material.

Figure 7:
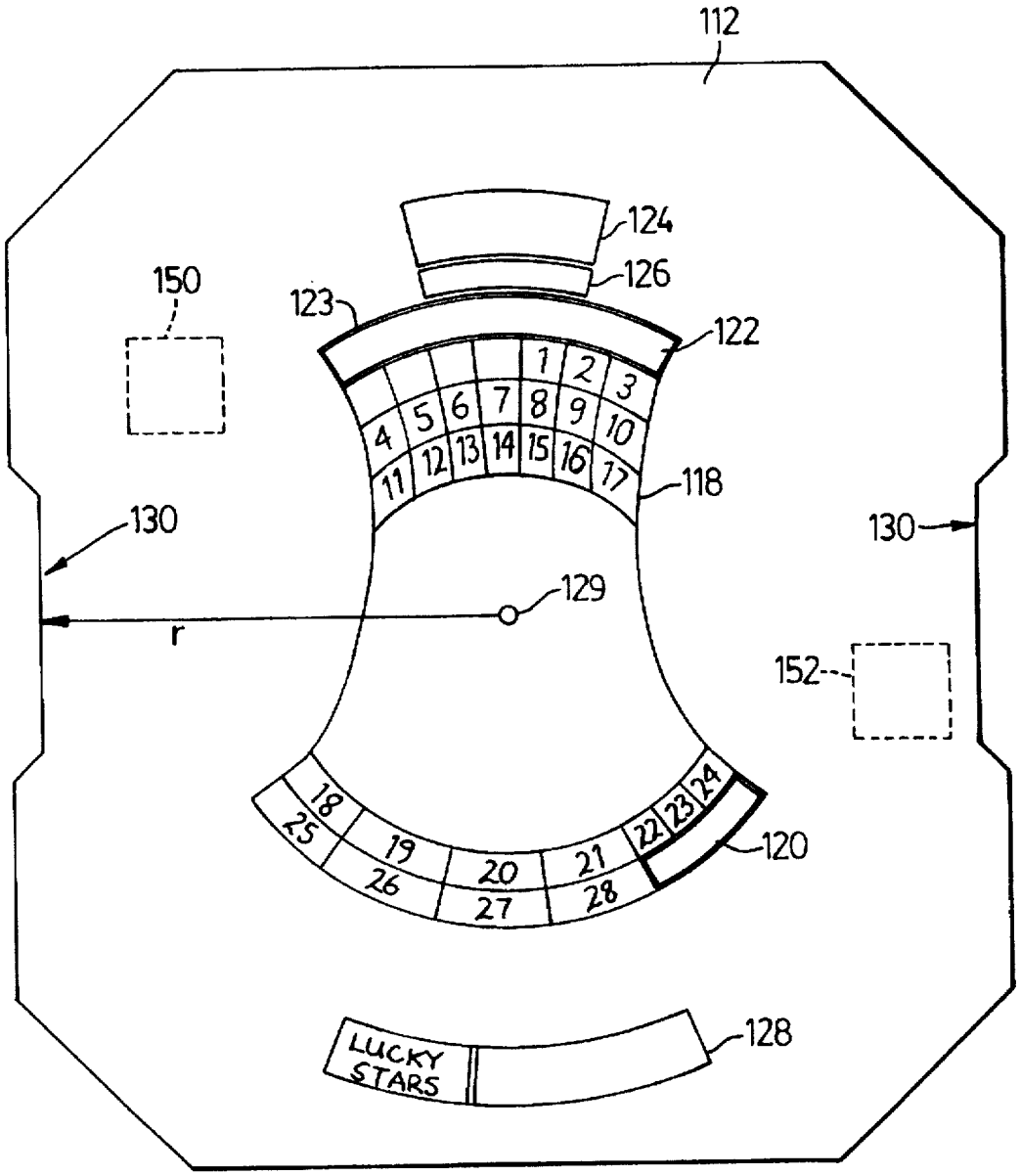
FIG. 7 is an illustration of a first, topmost substrate layer of the flat perpetual calendar device illustrated in FIG. 6.

Referring to FIG. 7, the topmost sheet 112 bears on a top surface thereof a calendar date chart 118. The chart may be directly embossed or printed on the sheet, or the chart 118 may be a label adhesively bonded to the surface of the sheet 112. The chart 118 display the dates of a month from the numbers "1" to "28", preferably in seven vertical columns, along five generally horizontal, albeit arcuate rows. The chart 118 also includes an empty region surrounding a central rotation axis 129 due to the opposing curvatures of the upper and lower rows of dates. The seven columns include top and bottom portions and left and right columns. The top and bottom portions are located respectively above and below the rotation axis 129 and the left and right columns are arranged respectively to the left and right of the rotation axis. The chart 118 is preferably constructed such that dates "1" to "3" are in the first row while dates "25" to "28" are situated in the last horizontal row. In alternative embodiments, however, other arrangements for the dates may be employed, such as placing dates "1" to "28" in only four generally horizontal rows.

Top sheet 112 is equipped with preferably five windows or viewing apertures, indicated by reference numerals 120, 122, 124, 126 and 128, which are used to display calendar date data. Viewing aperture 124 is employed to display the current month, such as one of "May", "June", "July", etc. It can also be employed to display the number of the month, such as "12" for the month of December, although this is not shown in FIG. 6. Viewing aperture 126 is optional (disclosed in FIG. 7 but not disclosed in FIG. 6) and is employed to show the dates of special events for a given month, such as the 4th of July being Independence Day. Viewing apertures 124 and 126 can be placed almost anywhere outside of the confines of date chart 118, although the preferred positioning of the apertures is slightly above chart 118.

Viewing aperture 128 is employed to display the zodiac names and signs corresponding to the current calendar month, there being two zodiac signs applicable for each calendar month. Preferably this zodiac sign information includes an indication of the dates during each month to which each of the two zodiac signs applies (as shown in FIGS. 6 and 9).

Viewing aperture 122 is employed to display letters representing days of the week, as will be explained in greater detail below. This aperture is preferably situated directly atop date chart 118 and has a width approximately equal to the first row thereof so as to display only seven days of the week.

Viewing aperture 120, situated proximate to date chart 118, is employed to display "variable" ending dates of the calendar month since the calendar months do not all have an equal number of days. As shown in FIG. 6, for example, for the month of December, which has 31 days, the numbers "29", "30" and "31" are displayed in aperture 120 after the date number "28". This aperture is preferably physically situated in the last horizontal row of chart 18 immediately after date "28". Of course, in the alternative embodiment described above having only four rows in date chart 18, viewing aperture 120 would be placed by itself at the beginning of a fifth row, or at any other logical position proximate to date chart 118.

Figure 8:
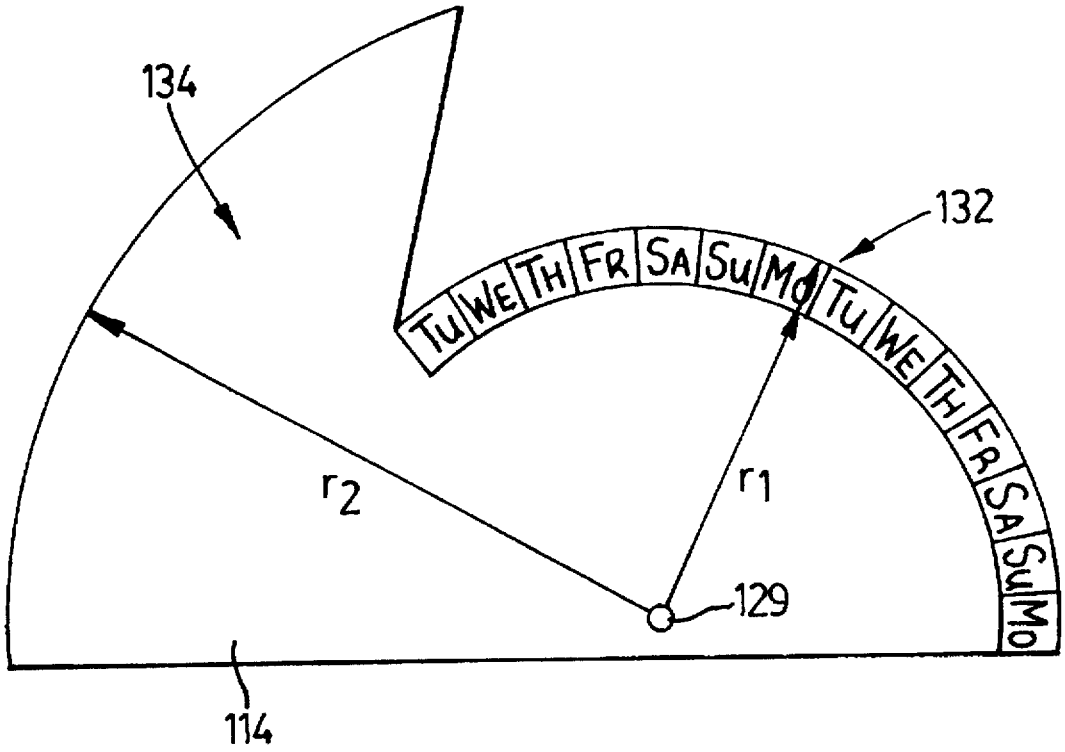
FIG. 8 is an illustration of an intermediate substrate layer of the flat perpetual calender for disposition beneath the top most substrate.
Figure 9:
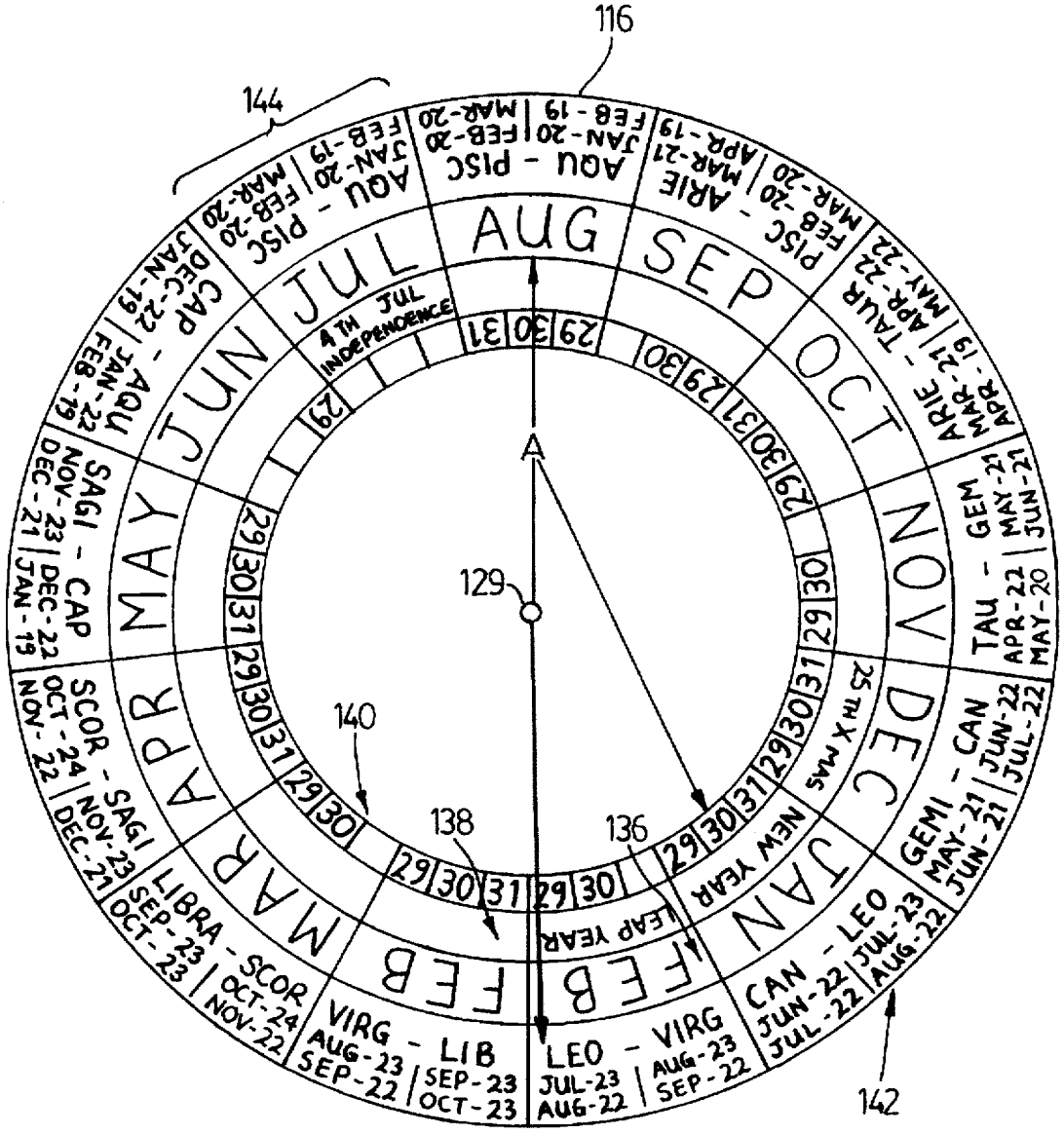
FIG. 9 is an illustration of a bottom-most substrate layer of the flat perpetual calendar for disposition beneath the intermediate substrate.

The underlying information or data which is displayed through viewing apertures 120, 122, 124, 126 and 128 is shown in FIGS. 8 and 9. FIG. 8, which illustrates the intermediate substrate or sheet member 114, contains an arcuate row of data 132 for the days of the week, which data is viewable through viewing aperture 122. Substrate 114 is preferably formed with a first semi-circular section having a radius $r_1$, and a second section 134 with a curved peripheral edge. The radius $r_1$ is sized substantially equal to the radial distance of outside edge 123 of viewing aperture 122 from the central axis 129 so that data 132, which is printed on the periphery of the first semi-circular section, can be viewed through the viewing aperture 122. The second section 134 has a radius $r_2$ which is sized slightly greater than the distance r from central axis 129 to an indentation 130 in the top sheet 112 (see FIG. 7) thereby enabling the section or extension 134 to function as a handle by which one may rotate intermediate substrate 114.

The days of the week data 132 is in the form of letters identifying days of the week. The correct sequence of letters for the data 132 is shown in FIG. 8, with the letters "MO" representing Monday, the letters "TU" representing Tuesday, etc. If a unilingual calendar is desired, one arcuate row of letters is sufficient. However, a second arcuate row of characters, disposed immediately beneath arcuate row of data 132, could be used to provide a second language weekday readout. Of course, viewing aperture 132 would have to be sufficiently sized so as to enable two arcuate rows to be viewable therethrough. In any event, viewing aperture 122 (see FIG. 6) has a width so as to only permit the display of seven letters or letter combinations (per horizontal row) representing the seven days of the week.

FIG. 9 shows the bottom-most substrate or sheet member 116 with a number of circumferential rows or rings of data 136, 138, 140 and 142 printed or embossed thereon. Data ring 136 comprises the names of the twelve months, but only one name of the current month is displayable through viewing aperture 124 due to the sizing thereof. Data ring 138 comprises information with respect to special events for a given month, with only the special event information for the current month being displayable through viewing aperture 126. Data ring 140 comprises the variable month-ending-data for the calendar year, but only the variable-ending dates for the current month are displayable through viewing aperture 120. Similarly, data ring 142 comprises the zodiac sign information corresponding to the calendar dates, with only the current month's data displayable through viewing aperture 128.

The data on the data rings 136, 138, 140 and 142 are collectively organized and aligned so as to form data wedges or sectors 144. However, it will be appreciated that each wedge 144 does not contain all the related calendar information for a given month. Instead, related information for a given month is distributed along the data rings according to the relative positioning of viewing apertures 120, 122, 124, 126 and 128. For example, the calendar date data for the month of August is distributed along the data rings as shown by the arrows originating from the letter "A" in FIG. 9. With this relationship, the month "August", its associated zodiac signs, variable month-ending dates, and special events information can be simultaneously displayed through viewing apertures 124, 128, 120, and 126 respectively.

It should be noted from FIG. 9 that the month of February is shown twice in month data ring 136. In addition, variable month-ending-date ring 140 and zodiac-sign data ring 142 each include two entries for the month of February. The reason for this is to accommodate leap years when February has 29 days instead of 28. Special events data ring 138 indicates which February setting is for leap years, which, if used, will result in the date number "29" appearing in the viewing aperture 120 and the words "leap year" appearing in viewing aperture 126.

The bottom substrate 116 is preferably circular with a diameter slightly greater than the length of an edge of the top sheet 112, which is preferably generally square in shape. The preferred sizing of bottom substrate 116 enables one to grasp the substrate 116 and rotate it to a desired setting, particularly if the top sheet 112 includes indentations 30 as shown in FIG. 2.

In use, the perpetual calendar of the invention must be set each month. To do so, one initially notes from another calendar the day of the week on which the first day of the current month falls. One then turns the intermediate substrate 114 until the correct day of the week is positioned directly above the number "1" on chart 18 representing the first day of the month. At the same time the bottom substrate 116 is turned so that the correct month appears in viewing aperture 124. Doing so will also cause the correct sequence of "variable dates" to appear in viewing aperture 120 and the correct zodiac sign data to appear in viewing aperture 128, thereby completing the calendar date display for the current month. Having set the calendar 110 initially in this manner, at the end of the current month the day of the week upon which it falls is noted, and the calendar 110 is reset as described above to have the next day of the week aligned with the number "1" representing the first day of the next month. Thus, the calendar 110 may be perpetually reset without referring to an external calendar source unless one chooses to do so (after the initial setting by the user).

It will be appreciated by those skilled in the art that a flat perpetual calendar embodying one or more aspects of this variation of the invention need not have all of the features of the illustrated flat calendar shown in the drawings. For example, it is possible to construct a flat perpetual calendar which, although capable of displaying the month ending dates or dates through viewing aperture 120, is not capable of displaying the additional 29th day for February in a leap year. The inability to display the 29th day for February would not seriously affect the usefulness of the calendar since this 29th day only appears once in four years. In such a version of the calendar it would only be necessary to display February once on data ring 140 of the bottom-most substrate 116.

It is also possible, of course, to construct a useful flat perpetual calendar in accordance with one aspect of the invention wherein the zodiac sign information for the selected month is not displayed through any viewing apertures. Thus, in a variation of the invention, viewing aperture 128 could be omitted along with the zodiac sign data ring 142 on the bottom substrate 116. On the other hand, it is also possible to construct a flat perpetual calendar which has the capability of displaying the zodiac sign information for the current month but which does not have a separate aperture, for example, for displaying the current month. The current month could, for example, be displayed through the same aperture as that used for the zodiac sign information. It is also possible to construct a perpetual calendar in accordance with the invention wherein all of the appropriate zodiac sign information for a particular month, there being two applicable zodiac signs for a given month, is shown through two separate viewing apertures. The advantage of showing the zodiac sign information through two separate viewing apertures is that it clearly separates the information relating to the two signs for the month and also the position of the two windows can correspond roughly to the location of the dates in the month for which the zodiac sign is appropriate. For example, the Capricorn sign can be displayed through an aperture 150 (shown in phantom) adjacent to the top three horizontal rows of data chart 118 during the month of January, which position corresponds roughly to the position of the initial 19 days in January for which the sign applies. Similarly, the Aquarius sign can appear during the month of January in an aperture 152 (shown in phantom) positioned adjacent to the bottom two rows of date chart 118, which position corresponds roughly to the last 12 days of January. Of course, in this embodiment substrate 116 would have to have the zodiac sign data properly distributed across the surface thereof.

It will also be appreciated that it is possible to display the 12 months of the year and the month ending date or dates in a different manner than that shown in FIGS. 6 to 9 and described above. For example, it is possible for the 12 months of the year to be displayed on one rotatable substrate while the "variable" month ending dates are displayed on a separate rotatable substrate, with both substrates being rotatably mounted to the top sheet member. Although such an arrangement is quite feasible, it might be less advantageous than the preferred embodiment illustrated in FIGS. 6 and 7, which embodiment always ensures that for every month displayed in aperture 134, the correct month ending date or dates will be shown in aperture 120.

The aperture or window 126 is, as mentioned above, optional and can be provided in the top sheet 112 for displaying a special day of a given month such as a national holiday or a religious date such as Christmas. As indicated, it also can be used to show "leap year" in the leap year month of February. This aperture can be located below the viewing aperture 124 for the month. Alternatively, this aperture need not be a separate window but can be combined with the viewing aperture 124 to form a single window displaying both the month and a special day therein. In addition, a personal date such as a birthday could be written on data ring 138 or placed on the data ring 138 by means of a sticker with the date printed thereon (not shown).

The flat calendar 10 can also be provided with a small clip or pin or the like (not shown). This additional element can function to prevent the settings on the calendar from changing due to small disturbances the calendar 110 may experience in the normal day to day handling thereof.

It will be appreciated that this variation of the present invention is a relatively inexpensive item to produce. Additionally, leap years are accurately accounted for and no further accessories need to be purchased in order for the calendar to work perpetually, unlike some calendar systems of the prior art.

It will also be appreciated by persons skilled in the art that the present invention is not limited by what has been particularly shown and described herein. Rather, the scope of the present invention is defined only by the claims which follow.

I therefore claim:

1. A perpetual calendar device comprising:

a first, flat, sheet member having at least first, second, third, and fourth viewing apertures formed therein, said sheet member displaying on a front surface thereof in seven columns and five approximately horizontal rows dates of the month from the numeral "1" to the numeral "28", said second viewing aperture being positioned above the seven columns and having a width substantially corresponding thereto; said third viewing aperture being positioned adjacent to the numeral 28 and to the right thereof to display up to three additional dates of the month after the numeral "28";

a second, flat, sheet member disposed beneath said first sheet member and rotatably mounted thereto, said second sheet member displaying on a front side thereof data for indicating days of the week, said second sheet member being rotatable to display days of the week data through said second viewing aperture for a given month; and a third, flat, sheet member disposed beneath said first sheet member and rotatably mounted thereto, said third sheet member displaying on a front side thereof the twelve months of the year, displaying variable month ending dates for months having more than 28 days, and displaying data relating to zodiac signs for each month of the year, said third sheet member being rotatable to display a given month through said first viewing aperture, correct month ending dates for said given month through said third viewing aperture, and data relating to a zodiac sign for said given month through said fourth aperture.

2. A perpetual calendar device according to claim 1 wherein said data for indicating days of the week comprises at least two similar sequences of representative letters arranged one after the other in a circumferential row on said second sheet member.

3. A perpetual calendar device comprising:

a first, flat sheet member having at least first, second and third viewing apertures formed therein, said sheet member displaying on the front surface thereof in seven columns dates of the month from the numeral "1" to the number "28", said second viewing aperture being positioned above the seven columns and having a width substantially corresponding thereto; said third viewing aperture being positioned to display up to three additional dates of the month after the numeral "28";

a second, flat sheet member disposed beneath said first sheet member and rotatably mounted thereto, said second sheet member displaying on a front side thereof data for indicating days of the week, said second sheet member being rotatable to display days of the week data through said second viewing aperture for a given month; and a third flat sheet member disposed beneath said first sheet member and rotatably mounted thereto, said third sheet member displaying on a front side thereof the twelve months of the year and further displaying variable month ending dates for the months having more than 28 days, said third sheet member being rotatable to display a given month through said first viewing aperture and correct month ending dates for said given month through said third viewing aperture, said third sheet member having the month of February displayed or represented twice thereon at first and second locations, the first location being positioned in said first viewing aperture to display or represent February in non leap years and the second location being positioned in said first viewing aperture for displaying or representing February in leap years, the date numeral "29" being displayed through said third viewing aperture when the second location is positioned in said first viewing aperture.

4. A perpetual calendar device comprising:

a first, flat, sheet member having at least first, second and third viewing apertures formed therein, said sheet member displaying on a front surface thereof in seven columns and five approximately horizontal rows dates of the month from the numeral "1" to the numeral "28", said dates of the month being displayed with only the numbers 1 to 3 in a top row and only the numbers "25" to "28" in a bottom horizontal row, said third viewing aperture being positioned adjacent to said bottom horizontal row, said second viewing aperture being positioned above the seven columns and having a width substantially corresponding thereto; said third viewing aperture being positioned adjacent to the numeral 28 and to the right thereof to display up to three additional dates of the month after the numeral "28";

a second, flat, sheet member disposed beneath said first sheet member and rotatably mounted thereto, said second sheet member displaying on a front side thereof data for indicating days of the week, said second sheet member being rotatable to display days of the week data through said second viewing aperture for a given month; and a third, flat, sheet member disposed beneath said first sheet member and rotatably mounted thereto, said third sheet member displaying on a front side thereof the twelve months of the year, and further displaying variable month ending dates for months having more than 28 days, said third sheet member being rotatable to display a given month through said first viewing aperture and correct month ending dates for said given month through said third viewing aperture.

5. A perpetual calendar device according to claim 4 wherein said third sheet member is sized larger than said second sheet member and disposed therebehind and wherein said first sheet member is at least approximately as large as said third sheet member.

6. A perpetual calendar device according to claim 5 wherein said first, second and third sheet members have a common axis of rotation approximately at the centre of said first sheet member.

7. A perpetual calendar device according to claim 6 wherein said second sheet member is formed with an extension sized to jut slightly beyond the outer perimeter of said first sheet member for enabling a person to grasp and rotate said second sheet member.

8. A perpetual calendar device according to claim 7 wherein said first sheet member is approximately square in shape, said second sheet member has a generally semi-circular section, and said third sheet member is circular in shape.

9. A perpetual calendar device according to claim 8 wherein said third sheet member has a diameter approximately the width of said first sheet member and said first sheet member has at least one indentation formed in the perimeter thereof for enabling a person to grasp and rotate said third sheet member.

10. A perpetual calendar comprising:

a flat, front sheet member having at least first and second viewing apertures formed therein, said sheet member displaying on a front surface thereof in seven columns and five approximately horizontal rows dates of the month from the number "1" to the number "28", said dates of the month being displayed with only the numbers 1 to 3 in a top row and only the numbers 25 to 28 in a bottom row, said second viewing aperture being positioned next to said bottom row adjacent to the number "28" and to the right thereof to display up to three additional dates of the month after the number "28", a flat, rotatable display sheet connected to said front sheet member and located on a rear side thereof, said display sheet displaying the twelve months of the year and month ending date or dates for months having more than 28 days, said display sheet being rotatable to display the current month through said first viewing aperture and correct month ending date or dates for said current month through said second viewing aperture; and a flat, day displaying member connected to said front sheet member for displaying data for indicating days of the week above said columns of dates of the month.

11. A perpetual calender according to claim 10 wherein said day displaying member is rotatably connected to said front sheet member and comprises a thin sheet member with a substantially semi-circular section, said data for indicating days of the week being located along the curved periphery of said semi-circular section.

12. A perpetual calendar according to claim 11 wherein said data for indicating days of the week comprises at least two similar sequences of representative letters arranged one after the other along said curved periphery.

13. A perpetual calendar according to claim 11 wherein said day displaying member is formed with an extension sized to jut slightly beyond at least a portion of an outer perimeter of said front sheet member for enabling a person to grasp and rotate said day displaying member.

14. A perpetual calendar according to claim 11 wherein said front sheet member is approximately square in shape and said rotatable display sheet is circular in shape.

15. A perpetual calendar comprising:

a flat, front sheet having at least first and second viewing apertures formed therein, said sheet member displaying on a front surface thereof in seven columns dates of the month from the number "1" to the number "28", said second viewing aperture being positioned to display up to three additional dates of the month after the number "28";

a flat, rotatable display sheet connected to said front sheet member and located on a rear side thereof, said display sheet displaying the twelve months of the year and month ending date or dates for months having more than 28 days, said display sheet being rotatable to display the current month through said first viewing aperture and correct month ending date or dates for said current month through said second viewing aperture, said rotatable display sheet having the month of February displayed twice thereon at first and second locations, the first location being positioned in said first viewing aperture to display February in non leap years and the second location being positioned to display February in leap years, and the date numeral "29" being displayed through said second viewing aperture when the second location is positioned in said first viewing aperture;

a flat, day displaying member connected to said front sheet member for displaying data for indicating days of the week above said columns of dates.

* * * * *